US011158971B2

(12) United States Patent
Ivancic et al.

(10) Patent No.: US 11,158,971 B2
(45) Date of Patent: Oct. 26, 2021

(54) PIN SETTING DEVICE FOR RETAINING A CONNECTOR IN A CABLE TAP

(71) Applicant: PPC BROADBAND, INC., East Syracuse, NY (US)

(72) Inventors: Joshua Ivancic, East Syracuse, NY (US); Douglas Jones, Cicero, NY (US)

(73) Assignee: PPC BROADBAND, INC., East Syracuse, NY (US)

( * ) Notice: Subject to any disclaimer, the term of this patent is extended or adjusted under 35 U.S.C. 154(b) by 0 days.

(21) Appl. No.: 16/808,680

(22) Filed: Mar. 4, 2020

(65) Prior Publication Data

US 2020/0287311 A1 Sep. 10, 2020

Related U.S. Application Data

(60) Provisional application No. 62/813,909, filed on Mar. 5, 2019.

(51) Int. Cl.

| | |
|---|---|
| ***H01R 13/17*** | (2006.01) |
| ***H01R 13/52*** | (2006.01) |
| ***H01R 13/622*** | (2006.01) |

(52) U.S. Cl.

CPC ..... *H01R 13/17* (2013.01); *H01R 13/5213* (2013.01); *H01R 13/622* (2013.01)

(58) Field of Classification Search

CPC ..... H01P 1/045; H01R 13/17; H01R 13/5213; H01R 13/595; H01R 11/32; H01R 24/547; H01R 25/003

See application file for complete search history.

(56) References Cited

U.S. PATENT DOCUMENTS

| | | | | |
|---|---|---|---|---|
| 2,805,399 | A * | 9/1957 | Leeper ..... | H01R 24/547 333/136 |
| 4,120,554 | A | 10/1978 | Bianchi et al. | |
| 5,610,370 | A | 3/1997 | Fremgen et al. | |
| 6,025,760 | A | 2/2000 | Tang | |

OTHER PUBLICATIONS

Blaine R. Copenheaver (Authorized Officer), International Search Report and Written Opinion dated May 7, 2020, PCT Application No. PCT/US2020/020885, 17 pages.

* cited by examiner

*Primary Examiner* — Vanessa Girardi

(74) *Attorney, Agent, or Firm* — MH2 Technology Law Group LLP

(57) ABSTRACT

A cable tap comprising: a first port configured to receive a connector; a second port; and a pin setting device installed within the second port, the pin setting device comprising: a plunger; and a biasing member configured to provide a biasing force to the plunger, which causes the plunger to apply a retaining force to the connector installed in the first port.

19 Claims, 3 Drawing Sheets

PIN SETTING DEVICE FOR RETAINING A CONNECTOR IN A CABLE TAP

CROSS-REFERENCE TO RELATED APPLICATIONS

This application claims priority to U.S. Provisional Patent Application 62/813,909, which was filed on Mar. 5, 2019, and is incorporated herein by reference in its entirety.

BACKGROUND

In cable-television networks, signals can be transmitted bi-directionally between a head-end and potentially many remote, subscriber premises. The networks employ a variety of devices to deliver and condition such signals to enhance quality and performance of the signal transmission.

One type of device that is employed in the networks is a tap. A tap is connected to an upstream portion of a distribution line at an input port. The tap also typically includes an output port, which is connected to a downstream portion of the distribution line. The distribution line thus may continue past the tap or may be terminated at the tap. The tap also provides one or more subscriber ports. A drop cable leading to a subscriber premises may be connected to each of the subscriber ports. The tap provides a splitter, such as a directional coupler, that provides a desired level of attenuation for the signals tapped off to the subscribers (a "tap value").

Taps generally include structures that ensure proper contact between the distribution line and the input and/or output ports. One such structure that is implemented is a set screw, which is received into a port formed through the housing of the tap, generally at a 90-degree angle to the input or output port. When tightened, the set screw presses the conductive portion of a connector that is connected to the distribution line into engagement with the contact. A dust cover can then be received over the set screw, thereby protecting port and the internal components from the surrounding environment.

While this assembly has been successfully implemented in a wide-variety of settings, there remain challenges with its implementation. For example, an installer may forget to tighten the set screw, and this may be undetectable, visually, once the dust cover is received over the set screw. Further, a set screw may be over-torqued or under-torqued, which may lead to damage of the connector or failure to ensure good contact, respectively. In addition, the set screw may be conductive, and thus may receive and then reflect signals when it is in contact with the conductive element of the distribution line and/or the contact of the tap port. As such, the set screw may reflect signals back into the distribution line and/or into the tap, which may manifest as noise in the signal, thereby decreasing the signal-to-noise ratio.

SUMMARY

In an example embodiment, a cable tap includes a housing defining a first port and a second port. The first port is configured to receive a connector configured to connect the cable tap to a distribution line. The second port intersects substantially perpendicularly with the first port. The cable tap further includes a pin setting device received in the second port. The pin setting device includes a plunger that is movable toward and away from the first port and configured to engage the connecter when the connector is installed in the first port and prevent the connector from displacement from the first port, and a biasing member coupled to the plunger and configured to apply a biasing force to the plunger such that the plunger presses against the connector when the connector is received into the first port. The biasing force causes the plunger to retain the connector in the first port. The pin setting device further comprises an outer body that is secured to the second port. The biasing member applies a reactionary biasing force onto the outer body. The pin setting device further includes a sleeve received at least partially in the outer body. The biasing member applies the reactionary biasing force onto the sleeve, and the sleeve transmits the reactionary biasing force to the outer body. When the outer body is connected in the second port, the sleeve engages the outer body such that the outer body prevents the sleeve from moving with respect thereto in at least one direction. The sleeve is slidable in at least one other direction relative to the outer body, and the outer body is removable from the second port without removing the sleeve or the pin setting device.

In an example embodiment, a method includes inserting a connector into a first port of a tap, wherein the connector is configured to connect the tap to a distribution line, tightening the connector into the first port, inserting a pin setting device into a second port after tightening the connector into the second port, wherein the pin setting device is configured to retain the connector within the tap, and tightening the pin setting device into the first port to cause a plunger to provide a retaining force against a pin of the connector, the retaining force being provided by a biasing within the pin setting device.

In an example embodiment, a pin setting device includes an outer body, a plunger within the outer body, connection features to connect the pin setting device to a cable tap, and a biasing member configured to provide a biasing force to the plunger and engage the plunger against a pin of a connector for retaining the pin in place when the connector is installed in the cable tap, wherein the connector connects the cable tap to a distribution line.

DETAILED DESCRIPTION

Figure 1:
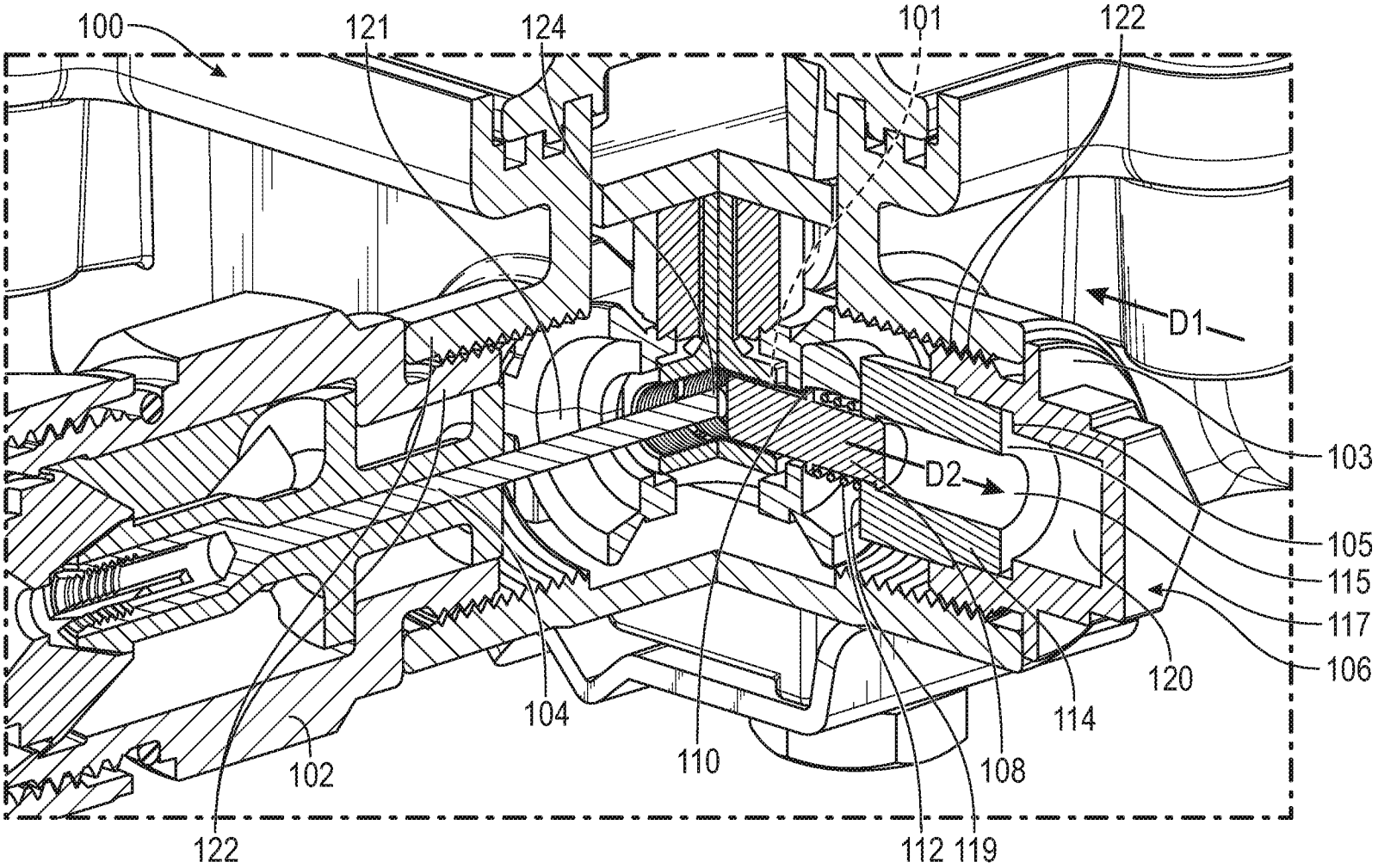
FIG. 1 shows a cross-sectional view of a cable tap having an example pin setting device in accordance with aspects of the present disclosure.

Certain embodiments of the disclosure will hereafter be described with reference to the accompanying drawings, wherein like reference numerals denote like elements. It should be understood, however, that the accompanying drawings illustrate only the various implementations described herein and are not meant to limit the scope of various technologies described herein. The drawings show and describe various embodiments of the current disclosure.

Aspects of the present disclosure include a tap (e.g., a cable tap) having a pin setting device that engages (e.g., grips) and retains a pin of a connector installed in the cable tap and connected to the distribution line. As described herein, the pin setting device retains the pin and thus the connector by holding the pin in place using a biasing force and gripping properties of a member in the pin setting device that engages the pin. In an example embodiment, the pin setting device includes a spring-loaded member (e.g., a plunger) that presses against the pin, thus retaining the pin and connector in place. As described herein, use of a spring-loaded member for retaining the pin eliminates the need to tighten a set screw to retain the pin. As such, the risk of omitting to tighten a set screw or fastener (e.g., by installer/technician omission or error) is eliminated. That is, aspects of the present disclosure eliminate a situation in which an installer or technician may forget to tighten a set screw which may lead to causes poor electrical performance. Further, aspects of the present disclosure eliminate a situation in which a set screw is tightened before fully tightening a connector, which may cause damage to the connector's pin.

As described herein, aspects of the present disclosure may integrate the pin setting device within a dust cap. Thus, installation of the dust cap will also result in the pin setting device engaging the pin of the connector, and retaining the pin and connector in place. That is, the integration of the pin setting cap combines the installation of the dust cap with the setting of the pin, eliminating a step in the connector installation process. Further, integrating the pin setting device in the dust cap may reduce instances in which installation of the dust cap is forgotten/omitted, thus preventing environmental debris and liquid from entering the cable tap and disrupting performance.

FIG. 1 shows a cross-sectional view of a cable tap 100 having an example pin setting device in accordance with aspects of the present disclosure. As shown in FIG. 1, a connector 102 is installed in a cable tap 100. As an illustrative example, the connector 102 may be a connector for a distribution cable to a cable television (CATV) network. In embodiments, the connector 102 includes a pin 104 that extends into the cable tap 100 for making an electrical connection between the connector 102 and the cable tap 100. The pin 104 (and hence, the connector 102) may be retained in place within the cable tap 100 by an integrated pin setting cap 106.

In an embodiment, the integrated pin setting cap 106 may include an outer body 103, a plunger 108, and a sleeve 114. The outer body 103 may be secured into a port 101 provided in the cable tap 100. For example, the outer body 103 may include threads 122 which may be configured to mesh with threads formed in the port 101 (e.g., to fasten the pin setting cap 106 to the cable tap 100). The sleeve 114 may be received at least partially in the outer body 103. For example, the sleeve 114 may include a radially-outward extending shoulder 105, which may be configured to bear against a complementary shoulder 115 formed in the outer body 103. The engagement between the shoulders 105, 115 may prevent the sleeve 114 from moving in at least one axial direction with respect to the outer body 103. In such a configuration, the outer body 103 may be removable from the port 101 without requiring removal of the sleeve 114. In some implementations, the sleeve 114 may be pressed into the outer body 103. The press fit may hold sleeve 114 together into the outer body 103.

The sleeve 114 includes a central bore 117 extending at least partially therethrough. The plunger 108 is slidably received at least partially within the bore 117 of the sleeve 114. Further, the plunger 108 may be biased away from the sleeve 114, e.g., via a spring 112 received around the plunger 108. The spring 112 may be a compression spring (or any other type of biasing member), which may be received axially between a shoulder 110 extending outwards from the plunger 108 and an end-face 119 of the sleeve 114. In embodiments, the sleeve 114 may be slidable in at least one other direction relative to the outer body 103, and the outer body 103 may be removable from the second port 121 without removing the sleeve 114 or the integrated pin setting cap 106.

As noted above, the sleeve 114 is prevented from moving with respect to the outer body 103 in at least one axial direction by the engagement between the shoulders 105, 115. For example, the sleeve 114 is prevented from moving away from the plunger 108, even when the spring 112 applies a force between the sleeve 114 and the plunger 108. As such, the plunger 108 is forced to move away from the sleeve 114, e.g., into engagement with the pin 104. This produces the clamping/gripping force against the pin 104, pressing the pin 104 into contact with an electrical contact 124 of the tap 100. In embodiments, the plunger 108 may include gripping features/properties to improve the gripping of the pin 104. For example, the plunger 108 may include anti-skid surfacing, rubber material, and/or other types of features and properties to improve the grip and retention of the pin 104.

In operation, to install the connector 102 in the cable tap 100, the integrated pin setting cap 106 is initially removed from the cable tap 100, or is extended outwardly from the cable tap 100 such that the pin 104 is fully insertable without obstruction from the plunger 108. In other words, the integrated pin setting cap 106 is initially removed from the cable tap 100, or is extended outwardly from the cable tap 100 such that a common space shared by the port 101 and the port 121 is free or empty. The connector 102 is inserted into the cable tap 100 (e.g., into a port 121 of the cable tap 100). The connector 102 is tightened within the port 121 (e.g., by screwing in the connector 102 by hand and/or using any suitable tool). Subsequently, the integrated pin setting cap 106 is installed in the port 121 of the cable tap 100 (e.g., in the direction of D1 and substantially perpendicularly to the connector 102). In embodiments, connection features (e.g., threads 122) may be provided on the integrated pin setting cap 106 to engage corresponding connection features (e.g., threads 122) within the cable tap 100. As the integrated pin setting cap 106 is installed in the direction of D1 (e.g., by screwing in and tightening the pin setting cap 106), the plunger 108 engages and grips the pin 104 while also providing a reactionary biasing force onto the sleeve 114, and the sleeve 114 transmits the reactionary force to the outer body 103. Concurrently, the plunger 108 retracts in the direction of D2 within the central bore 117 of the sleeve 114. As the integrated pin setting cap 106 continues to be tightened in the direction of D1, the plunger 108 provides a greater clamping/gripping force against the spring force of the spring 112. In this way, the pin 104 (and hence the connector 102) is retained snugly within the cable tap 100 such that the pin 104 maintains reliable and consistent electrical contact with the electrical contact 124 of the cable tap 100. Further, the integrated pin setting cap 106 serves as a dust cap to protect the interior of the cable tap 100 from debris, liquids, and/or other foreign objects that may damage and/or otherwise compromise the performance of the cable tap 100. As such, the use of a spring-loaded member (e.g., the plunger 108) for retaining the pin 104 eliminates the need to tighten a set screw or other type of fastener for retaining the pin 104. As such, the risk of omitting to tighten a set screw or fastener (e.g., by installer/technician omission or error) is eliminated.

Figure 2:
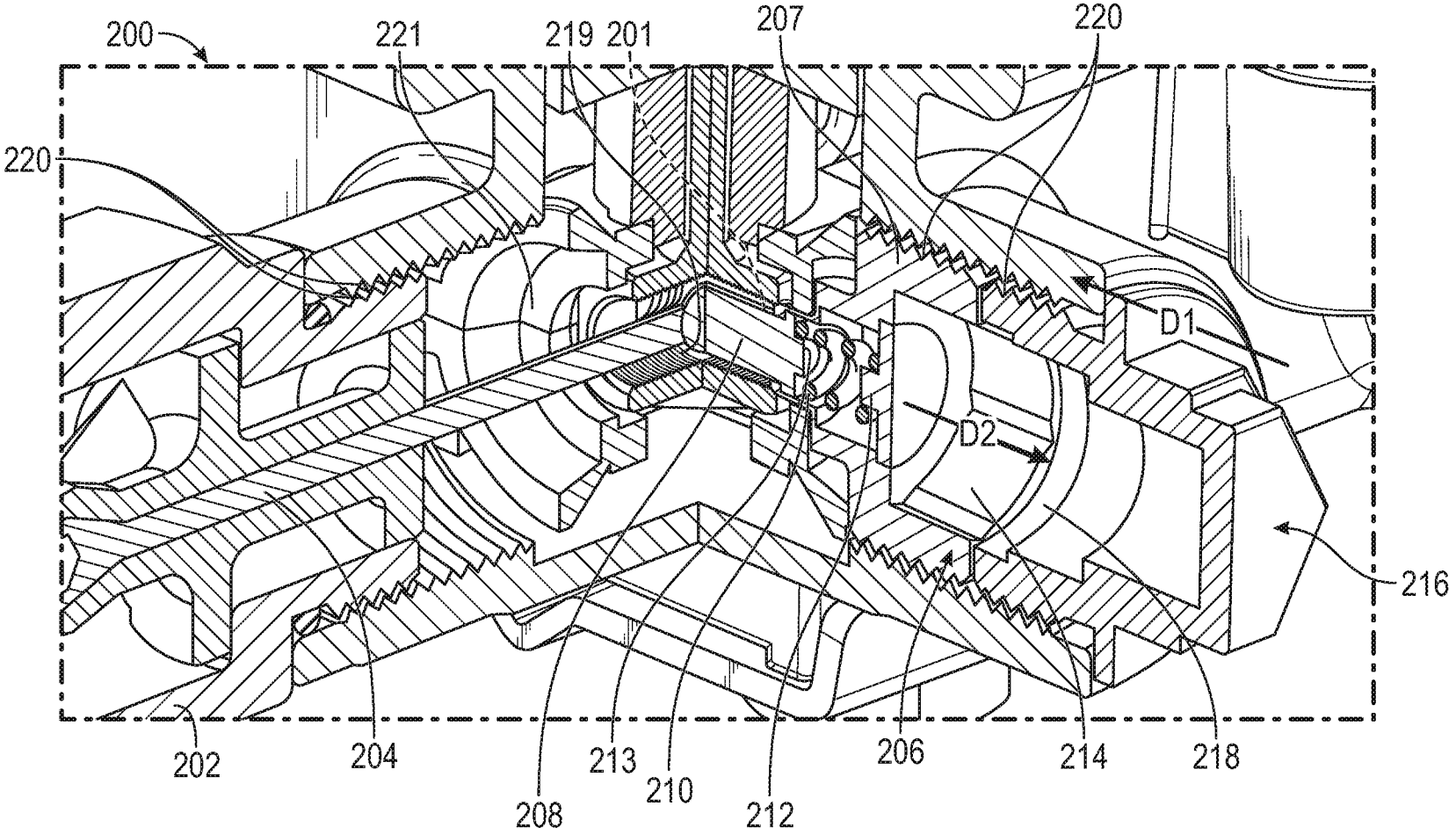
FIG. 2 shows a cross-sectional view of a cable tap having another example pin setting device in accordance with aspects of the present disclosure.

FIG. 2 shows a cross-sectional view of a cable tap 200 having an alternative example pin setting device in accordance with aspects of the present disclosure. As shown in FIG. 2 a cable tap 200 may include a pin setter 206. In this embodiment, the pin setter 206 may be a separate component from a dust cap 216.

In an embodiment, the pin setter 206 may include an outer body 207, a plunger 208, a spring 210, and a post 212. The outer body 207 may be secured into a port 201 provided in the cable tap 200. For example, the outer body 207 may include threads 220 which may be configured to mesh with threads formed in the port 201 of the tap 200. When secured via the threads 220, the pin setter 206 is prevented from moving in at least one axial direction with respect to the outer body 207.

The pin setter 206 further includes a bore 214. The plunger 208 is slidably received at least partially within the bore 214. The plunger 208 may be biased away from the pin setter 206, e.g., via a spring 210 received around the plunger 208. The spring 210 may be retained in place by the post 212 against a surface (e.g., an end-face 213) of the plunger 208.

As noted above, the pin setter 206 is prevented from moving with respect to the outer body 207 in at least one axial direction by the threads 220. For example, the pin setter 206 is prevented from moving away from the plunger 208, even when the spring 210 applies a force against the post 212 and the plunger 208. As such, the plunger 208 is forced to move away from the post 212, e.g., into engagement with the pin 204. This produces the clamping/gripping force against the pin 204, pressing the pin 204 into contact with an electrical contact 219 of the tap 200. In embodiments, the plunger 208 may include gripping features/properties to improve the gripping of the pin 204. For example, the plunger 108 may include anti-skid surfacing, rubber material, and/or other types of features and properties to improve the grip and retention of the pin 104

In operation, to install the connector 202 to the cable tap 200, the dust cap 216 and the pin setter 206 are initially removed completely, or partially, thus extended outwardly from the cable tap 200 (e.g., from the port 201) such the pin 204 is fully insertable without obstruction from the plunger 208. For example, the dust cap 216 and the pin setter 206 may be unscrewed from the threads 220 of the port 201. The connector 202 is inserted into the cable tap 200 (e.g., into a port 221 of the cable tap 200). The connector 202 is tightened within a port 221 (e.g., by screwing in the connector 202 via corresponding threads 220 on the connector 202 and the port 221). Subsequently, the pin setter 206 is installed in the cable tap 200 (e.g., in the direction of D1 and substantially perpendicularly to the connector 202). In embodiments, threads 220 may be provided at the pin setter 206 and to engage corresponding threads 220 within the cable tap 200. As the pin setter 206 is installed in the direction of D1 (e.g., by screwing in and tightening the pin setter 206), the plunger 208 engages the pin 204 and retracts in the direction of D2 within a bore 214 of the pin setter 206, and the bore 218 of the dust cap 216. As the pin setter 206 continues to be tightened in the direction of D1, the plunger 208 provides a greater clamping force against the spring force of the spring 210. In this way, the pin 204 (and hence the connector 202) is retained snugly within the cable tap 200 such that the pin 204 maintains reliable and consistent electrical contact with the electrical contact 219 of the cable tap 200. In embodiments, the dust cap 216 is installed in the direction of D1 after the pin setter 206 has been installed. In such an embodiment in which the dust cap 216 is separate from the pin setter 206, the dust cap 216 may be removed while the pin setter is in place to allow a technician to with access to the semiconductor in 204 to test for electrical conductivity of the pin 204.

In embodiments, any materials or composite of materials may be used to manufacture one or more of the components described herein. For example, the plunger 108/plunger 208 may be a plastic material, rubber material, and/or other form of dielectric material to prevent electrical interference of the connection between the connector 102/connector 202 and the cable tap 100/cable tap 200. When the plunger 108/plunger 208 is made of a dielectric material, the biasing member 112/212 is configured with a spring force sufficient to provide clamping force of the pin 104/204 against the electrical contact 124/219. Alternatively, the plunger 108/plunger 208 may be made of a conductive material (e.g., in an embodiment to allow a technician to test for electric connectivity using the plunger 108/plunger 208 as a contact point). In embodiments, the plunger 108/plunger 208 may include a soft rubber end or footing to prevent damage to the pin 104/pin 204 when gripped.

Figure 3:
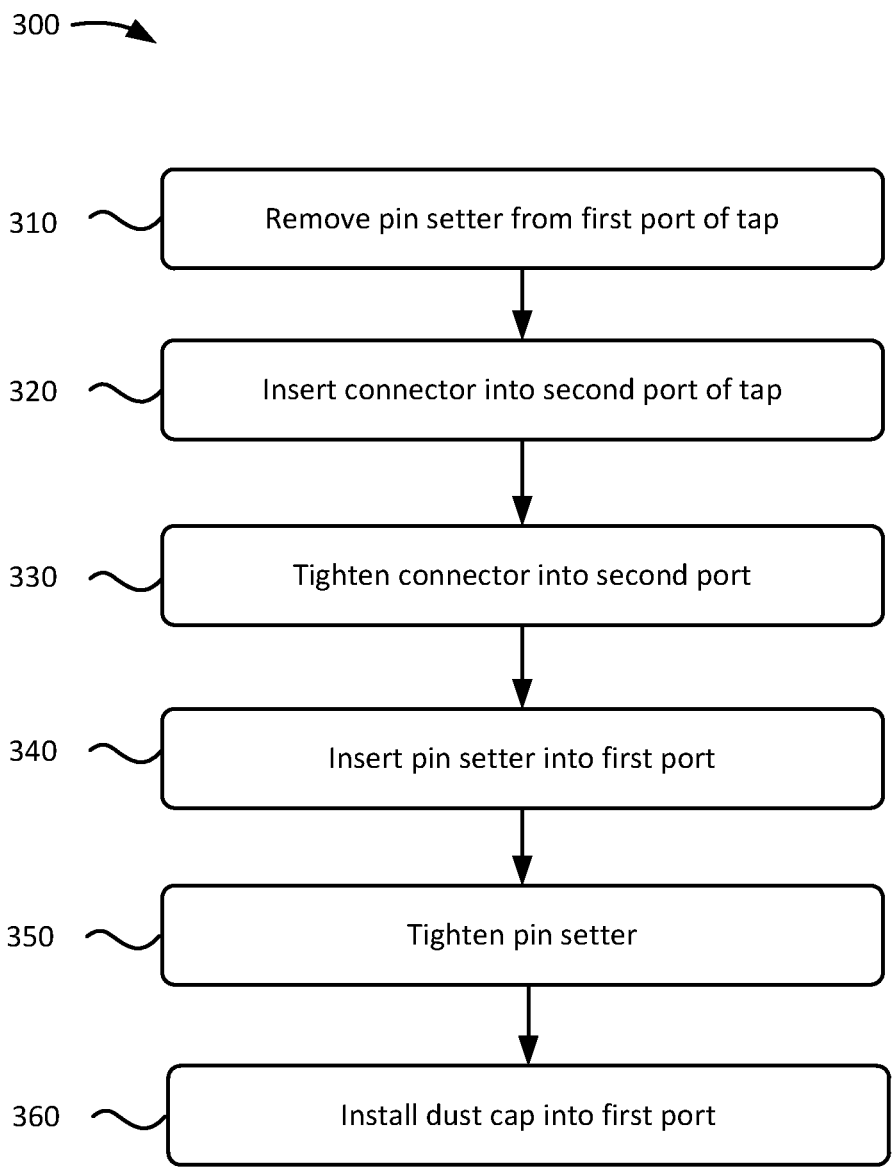
FIG. 3 illustrates an example process for installing a connector and securing the connector using the pin setter in accordance with aspects of the present disclosure.

FIG. 3 illustrates an example process 300 for installing a connector and securing the connector using the pin setter in accordance with aspects of the present disclosure. The example process 300 shown in FIG. 3 is for illustrative purposes only and may be modified in practice. For example, the steps shown may be omitted or performed in a different order than what is shown. One or more of the steps from process 300 may apply for installing either the integrated pin setting cap 106 from FIG. 1 or the pin setter 206 from FIG. 2.

As shown in FIG. 3, process 300 may include removing the pin setter from a first port of a tap (step 310). For example, the pin setter (e.g., the integrated pin setting cap 106 or the pin setter 206) is removed from a first port (e.g., port 101 or port 201) of a tap (e.g., tap 100 or tap 200). More specifically, the pin setter may be unscrewed from the port (e.g., by unscrewing threads of the pin setter from complementary threads for the port). In one example, the pin setter is removed from the first port completely such that the pin setter is completely detached and removed from the tap. Alternatively, the pin settler is partially removed from the port such that the pin setter is still attached to the tap while clearance is provided for installing a connector into the tap. In other words, the pen setter is initially removed from the cable tap, or is extended outwardly from the cable tap 100 such that a common space shared by the first port and a second port of the cable tap is free or empty.

Process 300 may further include inserting a connector into a second port of the tap (step 320). For example, a connector (e.g. connector 102 or connector 202) may be inserted into a second port of the tap (e.g., port 121 or port 221).

Process 300 may also include tightening the connector into the second port (step 330). For example, the connector is tightened into the second port (e.g., by screwing the threads of the connector into complementary threads of the second port).

Process 300 may further includes inserting the pin setter into the first port (step 340). For example, the pin setter is inserted into the first port to retain the connector in place.

Process 300 may also include tightening the pin setter (step 350). For example, the pin setter may be tightened by screwing in the pin setter into the port (e.g., screwing the threads of the pin setter into the complementary threads of the port).

Process 300 may further include installing a dust cap into the first port (step 360). For example, in an embodiment in which the pin setter 206 is used (e.g., when the dust cap 216 is separate from the pin setter 206), the dust cap is installed into the first port by screwing in the threads from the dust cap into the complimentary threads of the first port.

In embodiments, any number of installation techniques and suitable tools may be used to perform process steps of process 300. Further, any suitable torqueing specifications may be used for tightening the pin setter, the connector, and/or the dust cap. In embodiments, process 300 may be performed in reverses for uninstalling the connector from the tap.

The foregoing description provides illustration and description, but is not intended to be exhaustive or to limit the possible implementations to the precise form disclosed. Modifications and variations are possible in light of the above disclosure or may be acquired from practice of the implementations.

Even though particular combinations of features are recited in the claims and/or disclosed in the specification, these combinations are not intended to limit the disclosure of the possible implementations. In fact, many of these features may be combined in ways not specifically recited in the claims and/or disclosed in the specification. Although each dependent claim listed below may directly depend on only one other claim, the disclosure of the possible implementations includes each dependent claim in combination with every other claim in the claim set.

While the present disclosure has been disclosed with respect to a limited number of embodiments, those skilled in the art, having the benefit of this disclosure, will appreciate numerous modifications and variations there from. It is intended that the appended claims cover such modifications and variations as fall within the true spirit and scope of the disclosure.

No element, act, or instruction used in the present application should be construed as critical or essential unless explicitly described as such. Also, as used herein, the article "a" is intended to include one or more items and may be used interchangeably with "one or more." Where only one item is intended, the term "one" or similar language is used. Further, the phrase "based on" is intended to mean "based, at least in part, on" unless explicitly stated otherwise.

What is claimed is:

1. A pin setting device comprising:
an outer body;
a plunger within the outer body;
connection features to connect the pin setting device to a second port of a cable tap; and
a biasing member configured to provide a biasing force to the plunger and engage the plunger against a pin of a connector for retaining the pin in place when the connector is installed in a first port of the cable tap, wherein the connector connects the cable tap to a distribution line.

2. The pin setting device of claim 1, further comprising a dust cap integrated with the pin setting device.

3. The pin setting device of claim 1 further comprising a catch, wherein the biasing member is retained by the catch and the biasing member is provided between the catch and an end face of the plunger.

4. The pin setting device of claim 1, wherein the plunger comprises a material selected from the group consisting of:
a plastic;
a rubber;
a dielectric material; and
a conductive material.

5. The pin setting device of claim 1, wherein the connection features include threads.

6. The pin setting device of claim 1, wherein:
the biasing member applies a reactionary biasing force onto the outer body.

7. The pin setting device of claim 6, further comprising a sleeve received at least partially in the outer body.

8. The pin setting device of claim 7, wherein the biasing member applies the reactionary biasing force onto the sleeve, and the sleeve transmits the reactionary biasing force to the outer body.

9. The pin setting device of claim 7, wherein the sleeve defines a bore and the plunger is configured to retract within the bore by the biasing force.

10. A cable tap comprising:
a housing defining a first port and a second port, the first port configured to receive a connector configured to connect the cable tap to a distribution line, the second port intersecting substantially perpendicularly with the first port; and
a pin setting device received in the second port, the pin setting device comprising:
a plunger that is movable toward and away from the first port and configured to engage the connecter when the connector is installed in the first port and prevent the connector from displacement from the first port;
a biasing member coupled to the plunger and configured to apply a biasing force to the plunger such that the plunger presses against the connector when the connector is received into the first port, wherein the biasing force causes the plunger to retain the connector in the first port;
an outer body that is secured to the second port, wherein the biasing member applies a reactionary biasing force onto the outer body; and
a sleeve received at least partially in the outer body, wherein the biasing member applies the reactionary biasing force onto the sleeve, and the sleeve transmits the reactionary biasing force to the outer body, wherein:
when the outer body is connected in the second port, the sleeve engages the outer body such that the outer body prevents the sleeve from moving with respect thereto in at least one direction,
the sleeve is slidable in at least one other direction relative to the outer body, and
the outer body is removable from the second port without removing the sleeve or the pin setting device.

11. The cable tap of claim 10, wherein the plunger comprises a material selected from the group consisting of:
a plastic;
a rubber;
a dielectric material; and
a conductive material.

12. The cable tap of claim 10, further comprising a dust cap installed within the second port adjacent to and separate from the pin setting device.

13. The cable tap of claim 10, wherein the sleeve defines a bore and the plunger is configured to retract within the bore by the biasing force.

14. The cable tap of claim 10, further comprising a catch, wherein the biasing member is retained by the catch and the biasing member is provided between the catch and an end face of the plunger.

15. A method comprising:
inserting a connector into a first port of a tap, wherein the connector is configured to connect the tap to a distribution line;
tightening the connector into the first port;

inserting a pin setting device into a second port of the tap after tightening the connector into the second port, wherein the pin setting device is configured to retain the connector within the tap; and tightening the pin setting device into the first port to cause a plunger to provide a retaining force against a pin of the connector, the retaining force being provided by a biasing member within the pin setting device, wherein tightening the pin setting device into the first port causes the plunger to retract within a bore defined in a sleeve of the pin setting device.

16. The method of claim 15, further comprising:

installing a dust cap into the first port after tightening the pin setting device into the first port.

17. The method of claim 15, wherein inserting the connector into the first port of the tap includes inserting the connector when a common space shared by the first port and the second port is empty.

18. The method of claim 15, wherein tightening the connector into the first port causes the pin of the connector to reside at least partially a common space shared by the first port and the second port.

19. The method of claim 15, wherein the tightening the pin setting device into the first port causes the plunger to retain the pin within a common space shared by the first port and the second port.

* * * * *